United States Patent [19]

Terry

[11] 3,969,599

[45] July 13, 1976

[54] OFFSET PADDLE ACTUATOR FOR PUSH-ROD SWITCH

[75] Inventor: Ronald Terry, Princeton, Ind.

[73] Assignee: AMF Incorporated, White Plains, N.Y.

[22] Filed: Jan. 27, 1975

[21] Appl. No.: 544,053

[52] U.S. Cl. ..... 200/153 T; 200/335

[51] Int. Cl.[2] ..... H01H 3/20

[58] Field of Search..... 200/153 T, 153 R, 153 L, 200/159 R, 329, 340, 335

[56] References Cited

UNITED STATES PATENTS

| | | | |
|---|---|---|---|
| 3,144,537 | 8/1964 | Kiwi | 200/153 T |
| 3,375,340 | 3/1968 | Wright | 200/335 |

*Primary Examiner*—Herman Hohauser

*Attorney, Agent, or Firm*—George W. Price; John H. Gallagher

[57] ABSTRACT

A push-push type of switching apparatus having a push rod movable in a slideway on one face of a flat mounting bracket. A snap switch is mounted on the opposite face of the bracket. A pivotable actuating lever extends transversely through the bracket. The lever has one paddle portion in the slideway in the path of the push rod and a spaced second paddle positioned over the actuator of the snap switch. Depression of the push rod displaces the first paddle out of the path of the rod and pivots the lever. Pivoting of the lever causes the second paddle to depress the actuator button of the snap switch.

9 Claims, 5 Drawing Figures

OFFSET PADDLE ACTUATOR FOR PUSH-ROD SWITCH

BACKGROUND OF THE INVENTION

Push rod type switches have been produced in a configuration in which the push rod is part of a mechanism which includes a U-shaped channel member having its open side secured to the face of a flat mounting bracket so as to form a slideway for the push rod. A heart shaped cam and cam follower, together with spring biasing means, are associated with the push rod and channel member to provide the well known push-push type of movement for the rod.

The push rod is axially aligned with the actuator button or arm of a commercially available precision snap switch which also is secured to the face of the mounting bracket. Upon the first depression of the push rod it depresses the spring biased actuator of the snap switch to cause it to change its switching condition. This condition is maintained until a subsequent depression and then release of the push rod allows the push rod to return to its outermost position, thus releasing the actuator button of the snap switch and permitting it to return to its initial position.

Push rod switches of the type described have been extensively used with considerable success. However, in complex and crowded electronic equipment where space is at a premium it was found that the axial aignment of the push rod with the actuator button or lever of the precision snap switch presented a physical configuration which was somewhat elongated and required more space than was available.

SUMMARY OF THE PRESENT INVENTION

The push rod switch of the present invention results in a shorter more compact physical configuration which is better adapted for use in equipment where space is limited.

In the present invention, the push rod and its associated mechanism is mounted in offset relationship with respect to the precision snap switch actuator, as compared to being axially aligned as in prior art switches of this type. Additionally, the push rod and snap switch are mounted on opposite faces of the flat mounting bracket. A novel two bladed lever actuator has one blade or paddle within the U-shaped channel member and has a second blade or paddle located outside the channel member and on the other side of the mounting bracket for depressing the actuator button on the snap switch. When the push rod is in its outermost position the first blade of the actuator lever is in the push rod slideway in the path of movement of the push rod and the second blade of the actuator lever is above the spring biased switch actuator button and is exerting substantially no force thereon. When the push rod is depressed to its innermost position, a cam surface on its inner end displaces the first blade of the actuator lever out of its path of movement. Pivotal movement of the first blade causes the second blade to pivot onto the actuator button of the snap switch and depress it to place the switch in its other switched condition. The construction and arrangement of the two bladed actuator lever provides a simple and compact structure that is relatively simple to manufacture and is reliable in operation.

DETAILED DESCRIPTION OF PREFERRED EMBODIMENT

Figure 1:
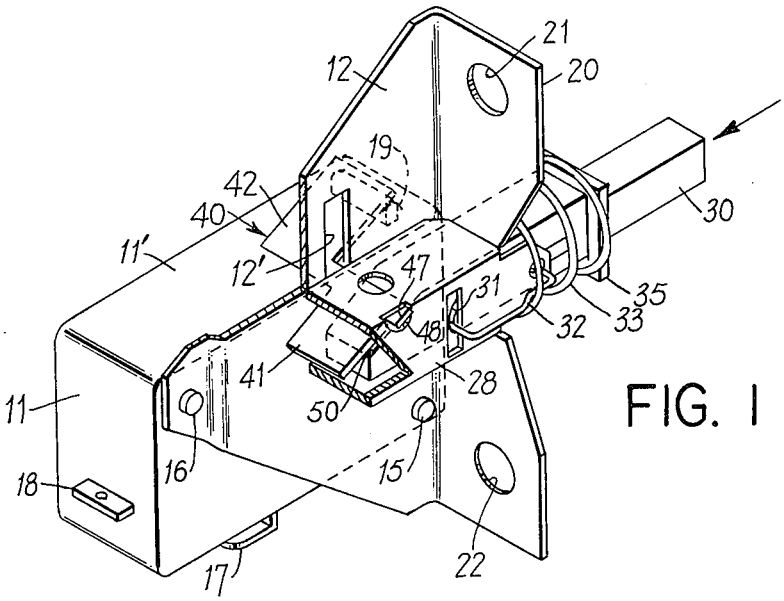
FIGS. 1 and 2 are perspective views, partially broken away, showing the switch apparatus of this invention in its two switching conditions.

In the accompanying drawings, a switch housing 11 is secured to a flat mounting bracket 12 by suitable means such as rivets 15 and 16. Switch housing 11 is a well known commercially available switch such as a model AlT precision snap switch available from Potter & Brumfield Division of AMF INCORPORATED, Princeton, Ind. Snap switch 11 has a common terminal 17 and a normally open (NO) terminal 18. Other combinations of terminals are available on switches of this type. A spring biased actuator button 19 may be depressed to change the switching condition of snap switch 11. As is known, snap switches also are available with various arrangements of lever arms which are operable with actuator button 19.

Flat mounting bracket 12 is provided with a flange 20 and mounting holes 21 and 22 for securing the bracket to the apparatus with which it is used.

An elongated U-shaped channel member 28 has its open side secured, as by staking, to one face of mounting bracket 12 so as to provide a slideway for push rod 30. Push rod 30 may be part of a push-push mechanism that includes a heart shaped cam 31 in the surface of the push rod, a cam follower pin 32, and a biasing spring 33 which is positioned between flange 20 on mounting bracket 12 and a flange 35 on push rod 30. The details of the push-push mechanism form no part of the present invention. Any of various types of push-push mechanisms may be used. See for example U.S. Pat. Nos. 2,671,354; 3,229,548; 3,493,705; 3,556,705; 3,582,522. The practice of the present invention does not require a push mechanism that retains the push rod at the innermost and outermost extremes of its motion, as described above. Push rod 30 could simply be spring biased to its outermost position and the switching action performed in snap switch 11 could be a monmentary closure and/or opening of its contacts.

Figure 2:
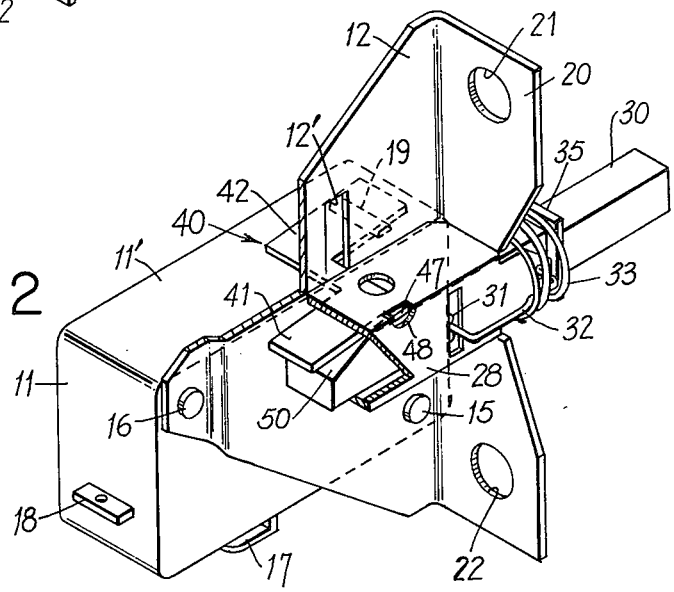
Figure 3:
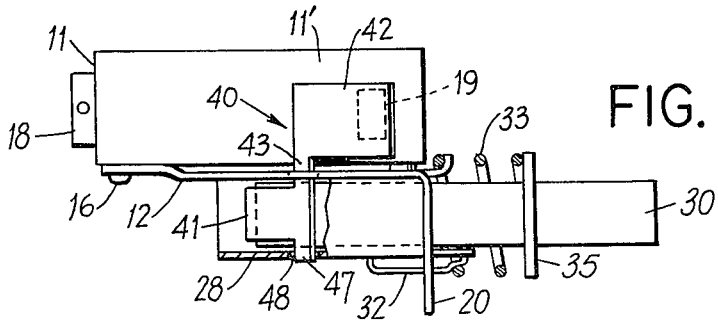
FIG. 3 is a side view, partially broken away, of the switch apparatus of this invention.
Figure 4:
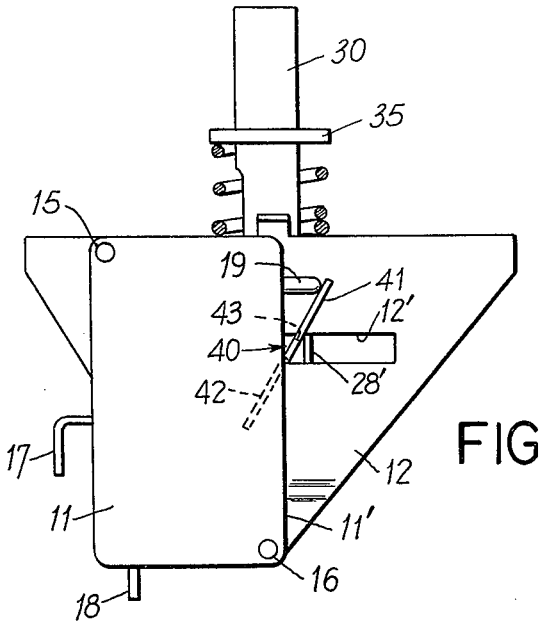
FIG. 4 is a plan view of one face of the switch apparatus.

As illustrated in FIG. 3, actuator button 19 of snap switch 11 is offset from the axial path of movement of push rod 30 and is located above the bottom end of the rod, see FIG. 3. The axial motion of push rod 30 is transmitted to actuator button 19 by means of actuator lever 40 which passes through a slot 12' in mounting bracket 12. Lever 40 has respective blades or paddles 41 and 42 disposed on opposite sides of the mounting bracket. The two paddles 41 and 42 extend in opposite directions and are joined by a narrow transversely extending intermediate portion 43. As illustrated in FIG. 4, the narrow intermediate portion 43 of lever 40 is pivotally retained in a bearing-like arrangement formed by the end slot 12' and one wall 28' of channel member 28. As illustrated in FIGS. 1, 2, and 3 the right end of lever 40 has a short tab 47 that is pivotally received in a notch 48 extending through the wall of channel member 28. As is seen, the upper edge of notch 48 is slightly rounded to prevent tab 47 from binding as it pivots in notch 48.

As best seen in FIGS. 1 and 2, the innermost end of push rod 30 has a cam surface 50 adapted to engage paddle 41 of actuator lever 40.

In operation, assuming first that push rod 30 is held at its outermost position illustrated in FIG. 1, the innermost end of push rod 30 is sufficiently withdrawn in channel member 28 to permit downwardly extending paddle 41 to be rotated across the slideway and into the path of movement of the push rod. The force for pivoting the first paddle 41 into the slideway is supplied by spring biased actuator button 19 of snap switch 11 which pivots the upwardly extending paddle member 42 outwardly away from surface 11'. In the arrangement illustrated in FIG. 1, with actuator button 19 in its outermost position, snap switch 11 is in its first switching condition.

Upon the axial depression of push rod 30, cam surface 50 at the end of the rod pushes against paddle 41 and pivots it in a clockwise direction, FIGS. 1 and 2, out of the axial path of movement of the push rod. The pivoting of first paddle 41 about the narrow transverse portion 43 causes the second paddle 42 to rotate downwardly to depress actuator button 19 to place snap switch 11 in its second switching condition. If a push-push mechanism of the type illustrated is to be employed, paddle 42 will maintain actuator button 19 in a depressed position until push rod 30 again is pushed and then released to allow the rod to return to its position illustrated in FIG. 1. During this return movement, cam surface 50 on the end of the push rod is withdrawn away from first paddle 41. Spring biased actuator button 19 then pivots lever 40 back to its FIG. 1 position where first paddle 41 again is positioned across the slideway in the path of travel of push rod 30.

Figure 5:
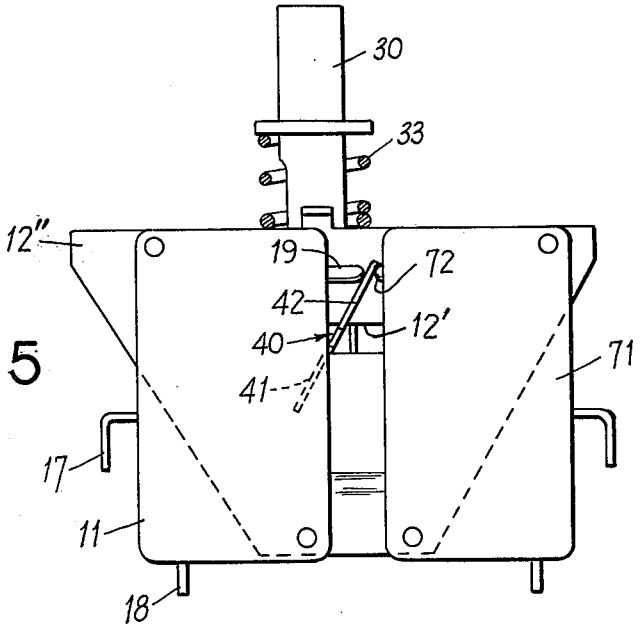
FIG. 5 is an illustration of the apparatus of this invention employed in the control of two switches.

The principles of this invention may be employed substantially without change to control the switching operations of two snap switches. As illustrated in FIG. 5, push rod 30 and its mounting on mounting plate 12'', as well as the mounting of snap switch 11 on the mounting plate, is identical to the arrangement described above. Similarly, actuating lever 40 with its two paddles 41 and 42 is identical to the arrangement described previously. In the embodiment illustrated in FIG. 5, mounting plate 12'' is somewhat enlarged on its right side and a second snap switch 71 is secured to it. Actuating button 72 of the second switch is in control with, and depressed by, paddle 42 when push rod 30 is in its outermost position. In this arrangement, the spring biasing force that urges actuator button 19 of switch 11 outwardly is stronger than the biasing force on actuator button 72 of the second switch 71. This allows actuator button 19 to pivot paddle 42 clockwise to depress actuator button 72 when push rod 30 is at its outermost position. When push rod 30 is depressed to its innermost position in the manner previously described, and as illustrated in FIG. 2, paddle 42 is rotated in a counterclockwise direction, as viewed in FIG. 5, to depress actuator button 19 and transfer snap switch 11 to its second switching condition. As paddle 42 rotates counterclockwise, spring biased actuator button 72 will extend outwardly to its outermost position to transfer the switching condition of second snap switch 71. Thus the switching operations of two switches is controlled by the same basic apparatus used without modifications and the resultant physical configuration still is relatively compact.

From the above discussion it is seen that the push rod switch apparatus of this invention is a relatively short and compact structure. The double paddle actuator lever 40 permits snap switch 11 to be mounted on mounting bracket 12 in offset relationship to push rod 30. The means for pivotally supporting actuator lever 40 minimizes the construction effort and expense of the apparatus.

What is claimed is:

1. A push rod mechanism for use in actuating a switch comprising a push rod, a mounting bracket, a slideway associated with said bracket and adapted to receive said push rod, said push rod being axially movable through said slideway between first and second positions, an actuating lever having first and second spaced apart paddle-like portions, means for pivotally mounting said actuating lever to place said first paddle-like portion in said slideway in the path of said push rod when the rod is in its first position, the first paddle-like portion being pivoted by said push rod when the rod moves to its second position, switch means having actuator means thereon mounted on said mounting bracket, said switch actuator means being located adjacent said second paddle-like portion to be actuated by said second paddle-like portion when the first paddle-like portion is pivoted by the push rod.

2. Apparatus as claimed in claim 1 wherein said mounting bracket includes a thin flat surface, and wherein said slideway and switch means are disposed on opposite faces of said flat surface, and wherein said actuating lever includes a thin intermediate portion separating the two paddle-like portions, the actuating lever being disposed transversely of the mounting plate with the two paddle-like portions on opposite sides thereof and with its intermediate portion pivotally supported in said mounting plate.

3. Apparatus as claimed in claim 2 wherein said first paddle-like portion extends in the slideway in the same direction as the movement of the push rod from its first to its second position, and said second paddle-like portion extends in a direction opposite from that of the first paddle-like portion.

4. Apparatus as claimed in claim 1 wherein said actuating lever includes a pivot tab at one end adjacent the first paddle-like portion, and pivot means associated with said slideway for pivotally supporting said tab.

5. Apparatus claimed in claim 1 and further including second switch means having actuator means mounted on the same face of the mounting bracket as said first switch means, said second switch actuator means being in contact with the second paddle-like portion and being depressed thereby when the push rod is in its first position.

6. Apparatus claimed in claim 5 wherein said first and second switch actuator means are spring biased into engagement with the second paddle-like portion, the spring bias of the first switch actuator means being greater than that of the second switch actuator means.

7. A push rod mechanism for use in actuating a switch comprising a push rod, a flat mounting bracket, a U-shaped channel member disposed with its open side on one face of said bracket thereby defining a slideway for receiving said push rod and for permitting axial movement of the rod between first and second positions, an actuating lever having first and second oppositely extending paddles spaced by a narrow intermediate portion, a slot in said mounting bracket located to intersect the open face of said channel member, said actuating lever being disposed transversely of the mounting plate with its first paddle on one side thereof in said slideway and with its second paddle on the opposite side of the mounting plate.

the intermediate portion of the actuating lever being pivotally retained in said slot by said channel means, the first paddle being pivoted by the push rod when the rod moves to its second position, whereby the second paddle also is pivoted in response to movement of the push rod, a switch having actuator means mounted on the opposite face of said mounting bracket, said switch actuator means being spring biased and located to pivot the second paddle when the push rod is in its first position, said second paddle operating to depress said switch actuator means when the push rod is in its second position.

8. Apparatus as claimed in claim 7 wherein said first paddle extends in the slideway in the same direction as the movement of the push rod from its first to its second position, and said second paddle extends in a direction opposite from that of the first paddle.

9. The combination claimed in claim 8 and further including a second switch having actuator means mounted on said opposite face of the mounting bracket at a location to place its actuator means in contact with said second paddle, the second switch actuator having a spring bias of less magnitude than that of the first switch actuator means, said first switch actuator means pivoting the second paddle onto and depressing the second switch actuator means when said push rod is in its first position.

* * * * *